US005753588A

United States Patent [19]

Iida et al.

[11] Patent Number: 5,753,588

[45] Date of Patent: May 19, 1998

[54] HEAT SENSITIVE RECORDING MATERIAL

[75] Inventors: Takeshi Iida; Tatsuya Meguro; Tetsuo Tsuchida, all of Amagasaki, Japan

[73] Assignee: New Oji Paper Company Limited, Tokyo-to, Japan

[21] Appl. No.: 686,370

[22] Filed: Jul. 25, 1996

[30] Foreign Application Priority Data

Jul. 31, 1995 [JP] Japan ..... 7-194471

[51] Int. Cl.[6] ..... B41M 5/30

[52] U.S. Cl. ..... 503/217; 503/208; 503/209; 503/216; 503/220; 503/221

[58] Field of Search ..... 427/150, 151; 503/280, 209, 216, 217, 220, 221

[56] References Cited

U.S. PATENT DOCUMENTS 5,401,699 3/1995 Ohashi et al. ..... 503/217

*Primary Examiner*—Bruce H. Hess

*Attorney, Agent, or Firm*—Nikaido, Marmelstein, Murray & Oram LLP

[57] ABSTRACT

The present invention provides a heat sensitive recording material comprising a substrate and a recording layer thereon incorporating a colorless or light-colored basic dye and a color acceptor, the recording material being characterized in that, the basic dye comprises an indolyldiazaphthalide derivative of the formula (1), and the color acceptor comprises a diphenyl sulfone derivative of the formula (2) and/or a benzanilide derivative of the formula (3)

(1)

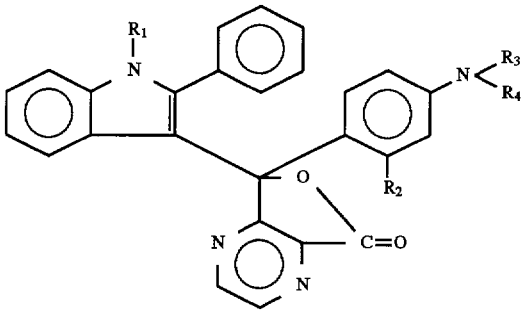

(2)

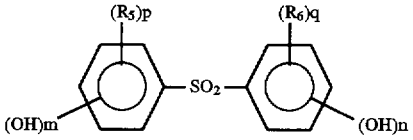

(3)

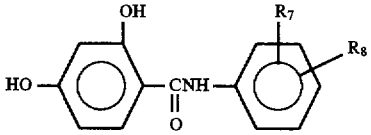

wherein $R_1$ to $R_8$ are defined in the specification.

8 Claims, No Drawings

HEAT SENSITIVE RECORDING MATERIAL

The present invention relates to heat sensitive recording materials utilizing a color forming reaction between a colorless or light-colored basic dye and a color acceptor, and more particularly to heat sensitive recording materials which are excellent in optical character readability (OCR) in the wavelength region of 650 to 700 nm.

Heat sensitive recording materials are well known which utilize a color forming reaction between a colorless or light-colored basic dye and an organic or inorganic color acceptor to obtain recorded images by thermally bringing the two chromogenic substances into contact with each other. Such heat sensitive recording materials are relatively inexpensive, while recording devices therefor are compact and relatively easy to maintain, so that these materials serve as recording media for facsimile systems, various computers, etc. and are also used in a wide variety of fields.

To meet diversified needs in recent years, various properties are required of heat sensitive recording materials. As one type of desired materials, it is required to provide heat sensitive recording materials for OCR or OMR which are adapted for reading in the wavelength region of 650 to 700 nm. Such recording materials are prepared, for example, by using a dye exhibiting strong absorption in the range of 650 to 700 nm when producing color, e.g., 3,3-bis(4-diethylamino-2-ethoxyphenyl)-4-azaphthalide, 3-di-n-butylamino-6,8,8-trimethyl-8,9-dihydro-9-ethyl-(3,2,e) pyridofluoran or the like, singly or in combination with a black-forming fluoran dye. However, it is strongly desired to improve the material prepared by the method because although having the property of OCR immediately after color formation, the material decreases this property when subjected to a high temperature and a high humidity or exposed to light.

An object of the present invention is to overcome the above problem and to provide a heat sensitive recording material which is outstanding in optical character readability (OCR) in the wavelength region of 650 to 700 nm.

We have found that the above object is fulfilled by a heat sensitive recording material which has a recording layer formed on a substrate and containing a colorless or light-colored basic dye and a color acceptor, the basic dye comprising at least one indolyldiazaphthalide derivative represented by the following formula (1), and the color acceptor comprising at least one compound selected from the group consisting of a diphenyl sulfone derivative represented by the following formula (2) and a benzanilide derivative represented by the following formula (3)

(1)

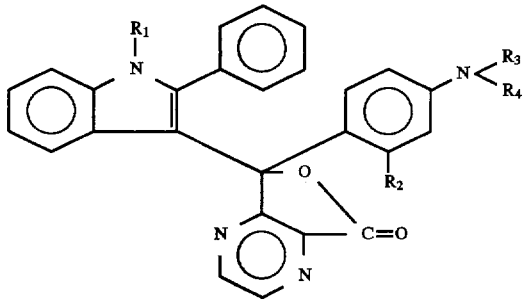

wherein $R_1$ is $C_1$~$C_8$ alkyl, $R_2$ is $C_1$~$C_6$ alkyl, $R_3$ and $R_4$ are each $C_1$~$C_6$ alkyl, or $R_3$ and $R_4$ may form a heteroring together with an adjacent nitrogen atom (2)

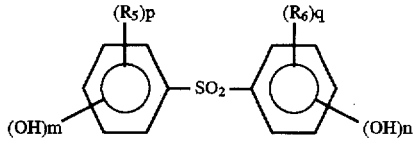

wherein $R_5$ and $R_6$ are each $C_1$~$C_4$ alkyl, $C_2$~$C_4$ alkenyl, $C_1$~$C_4$ alkoxyl, benzyloxy or a halogen atom, m is an integer of 0 to 2, n is an integer of 1 to 3, and p and q are each an integer of 0 to 2

(3)

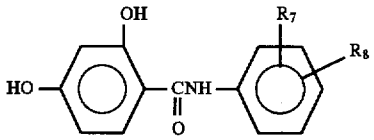

wherein $R_7$ is $C_1$~$C_4$ alkyl or $C_1$~$C_4$ alkoxyl, $R_8$ is a hydrogen atom, $C_1$~$C_4$ alkyl or $C_1$~$C_4$ alkoxyl. Thus, the present invention has been accomplished.

The present invention provides a heat sensitive recording material which is excellent in optical character readability (OCR) in the wavelength region of 650 to 700 nm even when exposed to a high temperature, high humidity or light for a long period of time, by using the specified indolyl-diazaphthalide derivative as a colorless or light-colored basic dye, and further using a specified diphenyl sulfone derivative and/or a specified benzanilide derivative as a color acceptor.

Examples of the indolylazaphthalide derivative used in the present invention and represented by the above formula (1) are as follows.

3-(1-methyl-2-phenylindol-3-yl)-3-(2-methyl-4-diethylaminophenyl)-4,7-diazaphthalide,
3-(1-methyl-2-phenylindol-3-yl)-3-(2-methyl-4-di-n-propylaminophenyl)-4,7-diazaphthalide,
3-(1-methyl-2-phenylindol-3-yl)-3-(2-methyl-4-di-n-butylaminophenyl)-4,7-diazaphthalide,
3-(1-methyl-2-phenylindol-3-yl)-3-(2-methyl-4-di-n-pentylaminophenyl)-4,7-diazaphthalide,
3-(1-methyl-2-phenylindol-3-yl)-3-(2-methyl-4-dimethylaminophenyl)-4,7-diazaphthalide,
3-(1-methyl-2-phenylindol-3-yl)-3-(2-methyl-4-pyrrolidinophenyl)-4,7-diazaphthalide,
3-(1-ethyl-2-phenylindol-3-yl)-3-(2-methyl-4-pyrrolidinophenyl)-4,7-diazaphthalide,
3-(1-n-butyl-2-phenylindol-3-yl)-3-(2-methyl-4-pyrrolidinophenyl)-4,7-diazaphthalide,
3-(1-ethyl-2-phenylindol-3-yl)-3-(2-methyl-4-diethylaminophenyl)-4,7-diazaphthalide,
3-(1-ethyl-2-phenylindol-3-yl)-3-(2-methyl-4-dimethylaminophenyl)-4,7-diazaphthalide,
3-(1-ethyl-2-phenylindol-3-yl)-3-(2-methyl-4-di-n-butylaminophenyl)-4,7-diazaphthalide,
3-(1-n-butyl-2-phenylindol-3-yl)-3-(2-methyl-4-diethylaminophenyl)-4,7-diazaphthalide,
3-(1-n-butyl-2-phenylindol-3-yl)-3-(2-methyl-4-di-n-butylaminophenyl)-4,7-diazaphthalide,
3-(1-methyl-2-phenylindol-3-yl)-3-(2-ethyl-4-diethylaminophenyl)-4,7-diazaphthalide,
3-(1-methyl-2-phenylindol-3-yl)-3-(2-ethyl-4-di-n-butylaminophenyl)-4,7-diazaphthalide,
3-(1-ethyl-2-phenylindol-3-yl)-3-(2-ethyl-4-diethylaminophenyl)-4,7-diazaphthalide,
3-(1-n-butyl-2-phenylindol-3-yl)-3-(2-ethyl-4-diethylaminophenyl)-4,7-diazaphthalide,
3-(1-n-octyl-2-phenylindol-3-yl)-3-(2-methyl-4-diethylaminophenyl)-4,7-diazaphthalide, 3-(1-methyl-2-phenylindol-3-yl)-3-(2-methyl-4-N-ethyl-N-isopentylaminophenyl)-4,7-diazaphthalide, 3-(1-methyl-2-phenylindol-3-yl)-3-(2-methyl-4-N-methyl-N-n-propylaminophenyl)-4,7-diazaphthalide.

Of course, the indolyldiazaphthalide derivative is not limited to the above and can be used in at least two of them as required.

Although, in the heat sensitive recording material of the invention, the above specific indolyldiazaphthalide derivative is used as a basic dye, it is possible to achieve more excellent OCR property by selectively combining as a color acceptor the above diphenyl sulfone derivative of the formula (2) and/or the above benzanilide derivative of the formula (3). Examples of the diphenyl sulfone derivatives are set forth below.

4,4'-Dihydroxydiphenyl sulfone, 2,4'-dihydroxydiphenyl sulfone, 3,3'-diallyl-4,4'-dihydroxydiphenyl sulfone, 3,3',5,5'-tetrabromo-4,4'-dihydroxydiphenyl sulfone, 3,3',5,5'-tetrachloro-4,4'-dihydroxydiphenyl sulfone, 4-hydroxydiphenyl sulfone, 4-hydroxy-4'-methyldiphenyl sulfone, 4-hydroxy-3',4'-tetramethylenediphenyl sulfone, 4-hydroxy-4'-methoxydiphenyl sulfone, 4-hydroxy-4'-ethoxydiphenyl sulfone, 4-hydroxy-4'-isopropoxydiphenyl sulfone, 4-hydroxy-4'-n-butoxydiphenyl sulfone, 4-hydroxy-4'-benzyloxydiphenyl sulfone, 3,4-dihydroxydiphenyl sulfone, 3,4-dihydroxy-4'-methyldiphenyl sulfone, 3,4,4'-trihydroxydiphenyl sulfone, 3,4,3',4'-tetrahydroxydiphenyl sulfone, 2,3,4-trihydroxydiphenyl sulfone.

Of course, the diphenyl sulfone derivative is not limited to the above and can be used in at least two of them as required.

Among these diphenyl sulfone derivatives, more preferable are 3,3'-diallyl-4,4'-dihydroxydiphenyl sulfone which can afford a heat sensitive recording material having excellent OCR property.

Examples of the benzanilide derivatives are set forth below.

2,4-Dihydroxy-2'-methylbenzanilide, 2,4-dihydroxy-3'-methylbenzanilide, 2,4-dihydroxy-4'-methylbenzanilide, 2,4-dihydroxy-2',4'-dimethylbenzanilide, 2,4-dihydroxy-4'-isopropylbenzanilide, 2,4-dihydroxy-2'-methoxybenzanilide, 2,4-dihydroxy-3'-methoxybenzanilide, 2,4-dihydroxy-4'-methoxybenzanilide, 2,4-dihydroxy-2'-ethoxybenzanilide, 2,4-dihydroxy-4'-ethoxybenzanilide, 2,4-dihydroxy-4'-isopropoxybenzanilide, 2,4-dihydroxy-2'-methoxy-4'-methylbenzanilide.

Of course, the benzanilide derivative is not limited to the above and can be used in at least two of them as required.

Among these benzanilide derivatives, more preferable is 2,4-dihydroxy-2'-methoxybenzanilide, which can afford a heat sensitive recording material having excellent OCR property.

The amount of the color acceptor is not specifically limited, but is generally 50 to 700 parts by weight, preferably 100 to 500 parts by weight per 100 parts by weight of the basic dye.

In the present invention, it is possible to conjointly use a known basic dye such as triarylmethane derivative, diarylmethane derivative, fluoran derivative, phenotiazine derivative, rhodamine derivative, spiropyran derivative and leucoauramine derivative in an amount which does not cause adverse effect.

Among these basic dyes, by using conjointly at least one fluoran compound of the formula (4), it is possible to obtain a heat sensitive recording material which produce a black color and achieve excellent effects in OCR property even when exposed to a high temperature, high humidity or light for a long period of time

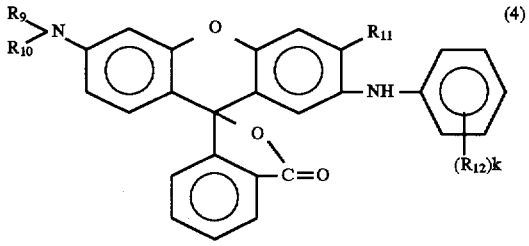

(4)

wherein $R_9$ and $R_{10}$ are each $C_1$~$C_6$ alkyl, ethoxypropyl or p-tolyl, $R_{11}$ is a hydrogen atom or methyl, $R_{12}$ is methyl, chlorine atom or trifluoromethyl, and k is an integer of 0 to 2.

In the present invention, the followings are examples of the black-forming fluoran derivatives represented by the formula (4).

3-Diethylamino-6-methyl-7-anilinofluoran,
3-di-n-butylamino-6-methyl-7-anilinofluoran,
3-diethylamino-6-methyl-7-(m-toluidino)fluoran,
3-di-n-butylamino-6-methyl-7-(m-toluidino)fluoran,
3-diethylamino-6-methyl-7-(2,4-xylidino)fluoran,
3-diethylamino-6-methyl-7-(3,5-xylidino)fluoran,
3-diethylamino-6-methyl-7-(2,6-xylidino)fluoran,
3-di-n-butylamino-6-methyl-7-(2,4-xylidino)fluoran,
3-di-n-butylamino-6-methyl-7-(3,5-xylidino)fluoran,
3-di-n-butylamino-6-methyl-7-(2,6-xylidino)fluoran,
3-dimethylamino-6-methyl-7-anilinofluoran,
3-di-n-propylamino-6-methyl-7-anilinofluoran,
3-(N-ethyl-p-toluidino)-6-methyl-7-anilinofluoran,
3-(N-ethyl-p-toluidino)-6-methyl-7-(p-toluidino)fluoran,
3-di-n-pentylamino-6-methyl-7-anilinofluoran,
3-(N-methyl-N-n-propylamino)-6-methyl-7-anilinofluoran,
3-(N-ethyl-N-isopentylamino)-6-methyl-7-anilinofluoran,
3-(N-ethyl-N-n-hexylamino)-6-methyl-7-anilinofluoran,
3-(N-ethyl-N-isobutylamino)-6-methyl-7-anilinofluoran,
3-diethylamino-7-(o-chloroanilino)fluoran,
3-di-n-butylamino-7-(o-chloroanilino)fluoran,
3-(N-ethyl-N-n-hexylamino)-7-(o-chloroanilino)fluoran,
3-(N-ethyl-N-isopentylamino)-7-(o-chloroanilino)fluoran,
3-di-n-butylamino-7-(o-fluoroanilino)fluoran,
3-di-n-butylamino-6-methyl-7-(p-chloroanilino)fluoran,
3-diethylamino-7-(m-trifluoromethylanilino)fluoran,
3-di-n-butylamino-7-(m-trifluoromethylanilino)fluoran,
3-diethylamino-6-methyl-7-(p-trifluoromethylanilino)fluoran,
3-(N-ethyl-N-ethoxypropylamino)-6-methyl-7-anilinofluoran,
3-(N-methyl-N-ethoxypropylamino)-6-methyl-7-anilinofluoran.

Among the above fluoran derivatives, especially preferable is 3-di-n-butylamino-6-methyl-7-anilinofluoran which achieves excellent effects in color forming ability and fogging in the background area.

In the present invention, it is possible to conjointly use an other known dye in an amount which does not cause adverse effect.

In the present heat sensitive recording material, it is possible to add various heat-fusible substances as a recording sensitivity improving agent to a recording layer. Examples of useful heat-fusible substances are caproic acid amide, capric acid amide, palmitic acid amide, stearic acid amide, oleic acid amide, erucic acid amide, linoleic acid amide, linolenic acid amide, N-methylstearic acid amide, stearic acid anilide, N-methyloleic acid amide, benzanilide, linoleic acid anilide, N-ethylcapric acid amide, N-butyllauric acid amide, N-octadecylacetamide, N-oleylacetamide, N-oleylbenzamide, N-stearylcyclohexylamide, polyethylene glycol, 1-benzyloxynaphthalene, 2-benzyloxynaphthalene, 1-hydroxynaphthoic acid phenyl ester, 1,2-diphenoxyethane, 1,4-diphenoxybutane, 1,2-bis(3-methylphenoxy)ethane, 1,2-bis(4-methoxyphenoxy)ethane, 1-phenoxy-2-(4-chlorophenoxy)ethane, 1-phenoxy-2-(4-methoxyphenoxy)ethane, 1-(2-methylphenoxy)-2-(4-methoxyphenoxy)ethane, dibenzyl terephthalate, dibenzyl oxalate, di(4-methylbenzyl)oxalate, benzyl p-benzyloxybenzoate, p-benzylbiphenyl, 1,5-bis(p-methoxyphenoxy)-3-oxapentane, 1,4-bis(2-vinyloxyethoxy)benzene, p-biphenyl p-tolyl ether, benzyl p-methylthiophenyl ether, 2-(2'-hydroxy-5'-methylphenyl)benzotriazole and 2-hydroxy-4-benzyloxybenzophenone.

It is desired that the amount of the recording sensitivity improving agent to be used be adjusted generally within the range of usually 50 to 1000 parts by weight, preferably 100 to 500 parts by weight per 100 parts by weight of the basic dye although not limited specifically.

It is possible to add various known preservability improving agent to a recording layer in order to further improve the preservability. Examples of useful preservability improving agents are 1,1,3-tris(2-methyl-4-hydroxy-5-cyclohexylphenyl)butane, 1,1,3-tris(2-methyl-4-hydroxy-5-tert-butylphenyl)butane, 4,4'-thiobis(3-methyl-6-tert-butylphenol), 1,3,5-trimethyl-2,4,6-tris(3,5-di-tert-butyl-4-hydroxybenzyl)-benzene, 2-(2-hydroxy-5-methylphenyl) benzotriazole, tetrakis(1,2,2,6,6-pentamethyl-4-piperidyl)-1,2,3,4-butanetetracarboxylate, 4-benzyloxyphenyl-4'-(2-methyl-2,3-epoxypropyloxy)phenyl sulfone, 1,3,5-tris(4-tert-butyl-3-hydroxy-2,6-dimethylbenzyl)isocyanuric acid, 1-[α-methyl-α-(4-hydroxyphenyl)ethyl]-4-[α',α'-bis(4-hydroxyphenyl)ethyl]-benzene, 4,4'-butylidenebis(6-tert-butyl-m-cresol), bis[2-hydroxy-3-(2'H-benzotriazole-2'-yl)-5-octylphenyl]methane, and sodium salt or magnesium salt of 2,2'-methylenebis(4,6-di-tert-butylphenyl)phosphoric acid.

For preparing a coating composition comprising the foregoing components, the dye, the color acceptor, the heat-fusible substance and the like are dispersed, together or individually, into water serving as a dispersing medium, using stirring and pulverizing means such as a ball mill, attritor, sand mill or colloid mill.

The heat sensitive recording material of the present invention is prepared generally by coating a suitable substrate with a coating composition which is obtained by dispersing the indolyldiazaphthalide derivative represented by the formula (1) as finely divided and the diphenyl sulfone derivative of the formula (2) and/or the benzanilide derivative of the formula (3) each as finely divided and serving as a color acceptor in a medium having a binder dissolved or dispersed therein.

In the present invention, a binder can be conjointly used in an amount of 10 to 40% by weight, preferably 15 to 35% by weight based on the total solids of the composition. Examples of useful binders are starches, hydroxyethyl cellulose, methyl cellulose, carboxymethyl cellulose, gelatin, casein, gum arabic, polyvinyl alcohol, styrene-maleic anhydride copolymer salt, styrene-acrylic acid copolymer salt, styrene-butadiene copolymer emulsion, etc.

Various other auxiliary agents can be further added to the coating composition. Examples of useful agents are dispersants such as sodium dioctylsulfosuccinate, sodium dodecylbenzenesulfonate, sodium salt of lauryl alcohol sulfuric acid ester, fatty acid metal salts, etc., ultraviolet absorbers such as triazole compounds, defoaming agents, fluorescent dyes, coloring dyes, antioxidants, etc. Further, to the composition may be added, in order to prevent sticking upon contact of the heat sensitive recording material with a recording device or a thermal head, a dispersion or emulsion of stearic acid, polyethylene, carnauba wax, paraffin wax, zinc stearate, calcium stearate, ester wax or the like.

In addition, to the composition may be added in order to prevent the adhesion of tailings to the thermal head, inorganic pigment such as kaolin, clay, talc, calcium carbonate, calcined clay, titanium oxide, kieselguhr, finely divided anhydrous silica, activated clay, etc.

Examples of useful substrates are paper (including also neutral sizing paper), plastic film, synthetic paper, sheets prepared by gluing a plastic film or synthetic paper to coated paper, wood-free paper or the like with an adhesive, and sheets obtained by laminating a plastic film to paper.

Examples of useful plastic films are those of polyethylene, polyester, polypropylene, polyvinyl chloride, polystyrene and nylon. Examples of useful synthetic papers are those prepared by film methods or the fiber method. The film methods include the internal paper making method wherein a synthetic resin, filler and additives are melted and kneaded, and the resulting mixture is extruded into a film, the surface coating method wherein a pigment coating layer is formed, and the surafce treating method. Synthetic papers obtained by the fiber method include synthetic pulp paper and spun bonded paper.

In the present heat sensitive recording material, the method of coating the recording layer is not particularly limited. For example, the coating composition is applied to a substrate by a bar coating, air knife coating, rod blade coating, pure blade coating, short dwell coating or like suitable means which are well known in the art and dried. In case of using a plastic film as the substrate, it is possible to enhance coating efficiency by subjecting the surface to corona discharge treatment, electron rays irradiation or the like. The amount of coating composition to be applied, which is not limited particularly, is usually 2 to 10 g/m$^2$, preferably 3 to 7 g/m$^2$, based on dry weight.

Further, it is possible to enhance resistance to chemicals such as a plasticizer or oil by providing on the heat sensitive recording layer a protective layer which is constituted by a binder, lubricant, pigment or the like.

Examples of binders usable in the protective layer are polyvinyl alcohol having various saponification degrees, acetoacetylated polyvinyl alcohol, carboxylated polyvinyl alcohol, silicone-modified polyvinyl alcohol, acrylic resin, polyurethane resin, etc. The binder can be used in an amount of 10 to 95% by weight, preferably 30 to 90% by weight based on the total solids of the protective layer. The protective layer is coated in an amount of 0.5 to 10 g/m$^2$, preferably 1 to 7 g/m$^2$, based on dry weight.

Various other known techniques in the field of heat sensitive recording materials can be applied. For example, it is possible to form on the protective layer a layer comprising a water-soluble, water-dispersible, electron ray-curable or ultraviolet ray-curable resin in order to provide excellent gloss, to form a protective layer on the rear surface of the substrate, to form an undercoat layer on the surface of the substrate.

The invention will be described below in more detail with reference to examples without limiting the scope thereof. In the followings, parts and percentages are all by weight, unless otherwise specified.

EXAMPLE 1

Intermediate layer

A coating composition for an intermediate layer was prepared by mixing together 100 parts of calcined clay (brand name: Ansilex, apparent specific gravity: 0.22 g/cm$^3$, product of Engelhard Minerals & Chemicals Corp.), 15 parts of styrene-butadiene copolymer latex (solids content: 50% ), 30 parts of 10% aqueous solution of polyvinyl alcohol and 200 parts of water. The coating composition obtained was applied to wood-free paper, weighing 50 g/m$^2$, in an amount of 10 g/m$^2$ when dried, followed by drying to form an intermediate layer.

Composition (A)

3-(1-Methyl-2-phenylindol-3-yl)-3-(2-methyl-4-diethylaminophenyl)-4,7-diazaphthalide (10 parts), 3 parts of 5% aqueous solution of methyl cellulose and 27 parts of water were pulverized by a sand mill to prepare Composition (A) having an average particle size of 0.8 μm.

Composition (B)

3,3'-Diallyl-4,4'-dihydroxydiphenyl sulfone (20 parts), 5 parts of 5% aqueous solution of methyl cellulose and 55 parts of water were pulverized by a sand mill to prepare Composition (B) having an average particle size of 1.2 μm.

Composition (C)

1,2-Bis(3-methylphenoxy)ethane (25 parts), 7 parts of 5% aqueous solution of methyl cellulose and 48 parts of water were pulverized by a sand mill to prepare Composition (C) having an average particle size of 1.2 μm.

Formation of a recording layer

A coating composition was prepared by mixing with stirring 40 parts of Composition (A), 80 parts of Composition (B), 80 parts of Composition (C), 10 parts of precipitated calcium carbonate, 20 parts of finely divided anhydrous silica (oil absorption: 180 ml/100 g), 15 parts of 30% aqueous dispersion of zinc stearate and 100 parts of 15% aqueous solution of polyvinyl alcohol. To the above intermediate layer was applied the above coating composition in an amount of 4 g/m$^2$ by dry weight, then dried and treated by a supercalender to obtain a heat sensitive recording paper.

EXAMPLES 2 to 15

Heat sensitive recording papers were prepared in the same manner as in Example 1 except that the following compounds were used in place of 10 parts of 3-(1-methyl-2-phenylindol-3-yl)-3-(2-methyl-4-diethylaminophenyl)-4,7-diazaphthalide in the preparation of Composition (A) in Example 1.

Example 2: 3-(1-methyl-2-phenylindol-3-yl)-3-(2-methyl-4-di-n-pentylaminophenyl)-4,7-diazaphthalide (10 parts)

Example 3: 3-(1-methyl-2-phenylindol-3-yl)-3-(2-methyl-4-diethylaminophenyl)-4,7-diazaphthalide (3 parts) and 3-di-n-butylamino-6-methyl-7-anilinofluoran (7 parts)

Example 4: 3-(1-methyl-2-phenylindol-3-yl)-3-(2-methyl-4-di-n-pentylaminophenyl)-4,7-diazaphthalide (3 parts) and 3-di-n-butylamino-6-methyl-7-anilinofluoran (7 parts)

Example 5: 3-(1-ethyl-2-phenylindol-3-yl)-3-(2-methyl-4-diethylaminophenyl)-4,7-diazaphthalide (3 parts) and 3-di-n-butylamino-6-methyl-7-anilinofluoran (7 parts)

Example 6: 3-(1-n-butyl-2-phenylindol-3-yl)-3-(2-methyl-4-diethylaminophenyl)-4,7-diazaphthalide (3 parts) and 3-di-n-butylamino-6-methyl-7-anilinofluoran (7 parts)

Example 7: 3-(1-methyl-2-phenylindol-3-yl)-3-(2-methyl-4-pyrrolidinophenyl)-4,7-diazaphthalide (3 parts) and 3-di-n-butylamino-6-methyl-7-anilinofluoran (7 parts)

Example 8: 3-(1-ethyl-2-phenylindol-3-yl)-3-(2-methyl-4-dimethylaminophenyl)-4,7-diazaphthalide (3 parts) and 3-di-n-butylamino-6-methyl-7-anilinofluoran (7 parts)

Example 9: 3-(1-methyl-2-phenylindol-3-yl)-3-(2-methyl-4-diethylaminophenyl)-4,7-diazaphthalide (3 parts) and 3-(N-ethyl-p-toluidino)-6-methyl-7-anilinofluoran (7 parts)

Example 10: 3-(1-methyl-2-phenylindol-3-yl)-3-(2-methyl-4-diethylaminophenyl)-4,7-diazaphthalide (3 parts) and 3-di-n-pentylamino-6-methyl-7-anilinofluoran (7 parts)

Example 11: 3-(1-methyl-2-phenylindol-3-yl)-3-(2-methyl-4-diethylaminophenyl)-4,7-diazaphthalide (3 parts) and 3-(N-ethyl-N-ethoxypropylamino)-6-methyl-7-anilinofluoran (7 parts)

Example 12: 3-(1-methyl-2-phenylindol-3-yl)-3-(2-methyl-4-diethylaminophenyl)-4,7-diazaphthalide (3 parts) and 3-di-n-butylamino-7-(o-chloroanilino)fluoran (7 parts)

Example 13: 3-(1-methyl-2-phenylindol-3-yl)-3-(2-methyl-4-diethylaminophenyl)-4,7-diazaphthalide (3 parts) and 3-dietylamino-7-(m-trifluoromethylanilino)fluoran (7 parts)

Example 14: 3-(1-methyl-2-phenylindol-3-yl)-3-(2-methyl-4-diethylaminophenyl)-4,7-diazaphthalide (4 parts) and 3-di-n-butylamino-6-methyl-7-anilinofluoran (6 parts)

Example 15: 3-(1-methyl-2-phenylindol-3-yl)-3-(2-methyl-4-diethylaminophenyl)-4,7-diazaphthalide (2 parts) and 3-di-n-butylamino-6-methyl-7-anilinofluoran (8 parts)

EXAMPLES 16 to 18

Heat sensitive recording papers were prepared in the same manner as in Example 3 except that the following compounds were used in place of 3,3'-diallyl-4,4'-dihydroxydiphenyl sulfone in the preparation of Composition (B) in Example 3.

Example 16: 4-hydroxy-4'-isopropoxydiphenyl sulfone

Example 17: 2,4'-dihydroxydiphenyl sulfone

Example 18: 2,4-dihydroxy-2'-methoxybenzanilide

Comparison Examples 1 to 3

Heat sensitive recording papers were prepared in the same manner as in Example 1 except that the following compounds were used in place of 10 parts of 3-(1-methyl-2-phenylindol-3-yl)-3-(2-methyl-4-diethylaminophenyl)-4,7-diazaphthalide in the preparation of Composition (A) in Example 1.

Com. Ex. 1: 3,3-bis(2-ethoxy-4-diethylaminophenyl)-4-azaphthalide (3 parts) and 3-di-n-butylamino-6-methyl-7-anilinofluoran (7 parts)

Com. Ex. 2: 3-di-n-butylamino-6,8,8-trimethyl-8,9-dihydro-9-ethyl-(3,2,e)pyridofluoran (3 parts) and 3-di-n-butylamino-6-methyl-7-anilinofluoran (7 parts)

Com. Ex. 3: 3-di-n-butylamino-6-methyl-7-anilinofluoran (10 parts)

Comparison Example 4

A heat sensitive recording paper was prepared in the same manner as in Example 3 except that 4,4'-isopropylidenediphenol was used in place of 3,3'-diallyl-4,4'-dihydroxydiphenyl sulfone.

The twenty two (22) kinds of heat sensitive recording materials thus obtained were evaluated by the following methods. The results were given in Table 1.

[PCS value]

The PCS value serves as an index indicating the degree of OCR property. The PCS value represents the relative density difference between a recorded area and an unrecorded area, and is given by the following equation $$PCS=(Rw-Rp)/Rw$$

wherein Rw is the reflectance of the unrecorded area, and Rp is the reflectance of the recorded area. Accordingly, the higher the PCS value, the more discernible is the recorded area from the unrecorded area and the higher is the readability. Generally, the PCS value should be at least 0.7.

[Measurement of PCS values at 670 nm]

Images were recorded on the heat sensitive recording material by a heat sensitive recording tester (Model TH-PMD, product of Ohkura Denki Co., Ltd., applied voltage 18 V, pulse cycle 3.0 ms, applied pulse width 1.6 ms). The reflectance of the recorded area and the unrecorded area was measured at a wavelength of 670 nm by a spectrophotometer (Model U-3300, product of Hitachi, Ltd.), and the PCS value was calculated from the measurements.

[Background fog]

The unrecorded area was checked for fog by a Macbeth densitometer (Model RD-914 with a visual filter, product of Macbeth Corp.).

[Resistance to moisture and heat]

The recording material used for recording was allowed to stand at 40° C. and 90% RH for 72 hours and thereafter checked for PCS value and background fog.

[Light fastness]

The recording material used for recording was exposed to SUNSHINE XENON LONG LIFE WEATHER METER (Suga Test Instruments Co., Ltd.) for 15 hours and thereafter checked for PCS value and background fog.

TABLE 1

| | | color formed | PCS value A | PCS value B | PCS value C | background fog A | background fog B | background fog C |
|---|---|---|---|---|---|---|---|---|
| Ex. | 1 | green | 0.90 | 0.79 | 0.78 | 0.06 | 0.08 | 0.08 |
| | 2 | green | 0.89 | 0.78 | 0.78 | 0.06 | 0.09 | 0.08 |
| | 3 | black | 0.87 | 0.79 | 0.79 | 0.05 | 0.07 | 0.07 |
| | 4 | black | 0.87 | 0.78 | 0.77 | 0.05 | 0.07 | 0.08 |
| | 5 | black | 0.86 | 0.77 | 0.78 | 0.05 | 0.07 | 0.07 |
| | 6 | black | 0.86 | 0.77 | 0.78 | 0.05 | 0.07 | 0.08 |
| | 7 | black | 0.87 | 0.79 | 0.79 | 0.06 | 0.08 | 0.08 |
| | 8 | black | 0.86 | 0.78 | 0.78 | 0.05 | 0.07 | 0.07 |
| | 9 | black | 0.82 | 0.72 | 0.74 | 0.05 | 0.06 | 0.06 |
| | 10 | black | 0.83 | 0.75 | 0.75 | 0.05 | 0.07 | 0.07 |
| | 11 | black | 0.84 | 0.74 | 0.75 | 0.06 | 0.09 | 0.10 |
| | 12 | black | 0.81 | 0.71 | 0.70 | 0.05 | 0.07 | 0.07 |
| | 13 | black | 0.82 | 0.73 | 0.71 | 0.05 | 0.07 | 0.07 |
| | 14 | black | 0.88 | 0.79 | 0.78 | 0.05 | 0.07 | 0.07 |
| | 15 | black | 0.85 | 0.77 | 0.77 | 0.05 | 0.07 | 0.07 |
| | 16 | black | 0.83 | 0.73 | 0.70 | 0.06 | 0.10 | 0.10 |
| | 17 | black | 0.81 | 0.71 | 0.72 | 0.05 | 0.09 | 0.10 |
| | 18 | black | 0.86 | 0.78 | 0.82 | 0.05 | 0.07 | 0.07 |
| Com.Ex. | 1 | greenish black | 0.85 | 0.65 | 0.28 | 0.09 | 0.20 | 0.14 |
| | 2 | black | 0.84 | 0.58 | 0.21 | 0.10 | 0.22 | 0.15 |
| | 3 | black | 0.75 | 0.61 | 0.23 | 0.05 | 0.07 | 0.14 |
| | 4 | black | 0.86 | 0.65 | 0.65 | 0.07 | 0.21 | 0.20 |

A: before test
B: after resistance test to moisture and heat
C: after exposure to light As apparent from the results in Table 1, the present heat sensitive recording material is high in initial PCS value and sufficiently high in PCS value at the wavelength of 670 nm even after exposed to a high temperature, high humidity or light for a long period of time and is less susceptible to background fogging.

We claim:

1. A heat sensitive recording material comprising a substrate and a recording layer thereon incorporating a colorless or light-colored basic dye and a color acceptor, the recording material being characterized in that, the basic dye comprises at least one indolyldiazaphthalide derivative represented by the following formula (1), and the color acceptor comprises at least one compound selected from the group consisting of a diphenyl sulfone derivative represented by the following formula (2) and a benzanilide derivative represented by the following formula (3)

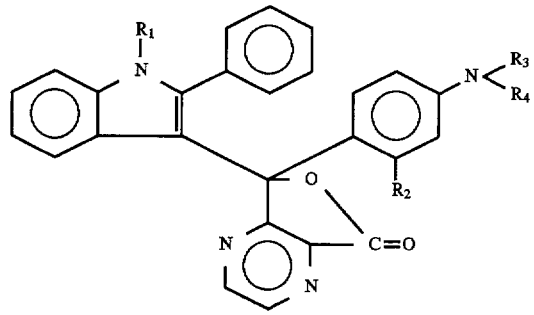

(1)

wherein $R_1$ is $C_1$~$C_8$ alkyl, $R_2$ is $C_1$~$C_6$ alkyl, $R_3$ and $R_4$ are each $C_1$~$C_6$ alkyl, or $R_3$ and $R_4$ may form a heteroring together with an adjacent nitrogen atom

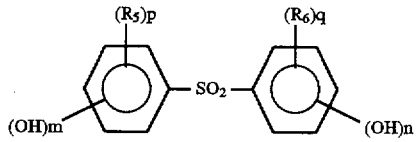

(2)

wherein $R_5$ and $R_6$ are each $C_1$~$C_4$ alkyl, $C_2$~$C_4$ alkenyl, $C_1$~$C_4$ alkoxyl, benzyloxy or a halogen atom, m is an integer of 0 to 2, n is an integer of 1 to 3, and p and q are each an integer of 0 to 2

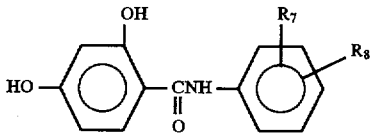

(3)

wherein $R_7$ is $C_1$~$C_4$ alkyl or $C_1$~$C_4$ alkoxyl, $R_8$ is a hydrogen atom, $C_1$~$C_4$ alkyl or $C_1$~$C_4$ alkoxyl.

2. A heat sensitive recording material as defined in claim 1 wherein the indolyldiazaphthalide derivative is 3-(1-methyl-2-phenylindol-3-yl)-3-(2-methyl-4-diethylaminophenyl)-4,7-diazaphthalide, 3-(1-methyl-2-phenylindol-3-yl)-3-(2-methyl-4-di-n-pentylaminophenyl)-4,7-diazaphthalide, 3-(1-ethyl-2-phenylindol-3-yl)-3-(2-methyl-4-diethylaminophenyl)-4,7-diazaphthalide, 3-(1-n-butyl-2-phenylindol-3-yl)-3-(2-methyl-4-diethylaminophenyl)-4,7-diazaphthalide, 3-(1-methyl-2-phenylindol-3-yl)-3-(2-methyl-4-pyrrolidinophenyl)-4,7-diazaphthalide or 3-(1-ethyl-2-phenylindol-3-yl)-3-(2-methyl-4-dimethylaminophenyl)-4,7-diazaphthalide.

3. A heat sensitive recording material as defined in claim 1 wherein the diphenyl sulfone derivative is 3,3'-diallyl-4,4'-dihydroxydiphenyl sulfone, 4-hydroxy-4'-isopropoxydiphenyl sulfone or 2,4'-dihydroxydiphenyl sulfone.

4. A heat sensitive recording material as defined in claim 3 wherein the diphenyl sulfone derivative is 3,3'-diallyl-4,4'-dihydroxydiphenyl sulfone.

5. A heat sensitive recording material as defined in claim 1 wherein the benzanilide derivative is 2,4-dihydroxy-2'-methoxybenzanilide.

6. A heat sensitive recording material as defined in claim 1 wherein the amount of the color acceptor is 50 to 700 parts by weight per 100 parts by weight of the basic dye.

7. A heat sensitive recording material as defined in claim 1 wherein at least one of fluoran compound represented by the following formula (4) is conjointly used with the basic dye

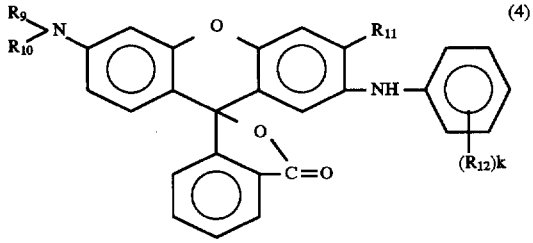

(4)

wherein $R_9$ and $R_{10}$ are each $C_1$~$C_6$ alkyl, ethoxypropyl or p-tolyl, $R_{11}$ is a hydrogen atom or methyl, $R_{12}$ is methyl, chlorine atom or trifluoromethyl, and k is an integer of 0 to 2.

8. A heat sensitive recording material as defined in claim 7 wherein the fluoran compound represented by the following formula (4) is 3-di-n-butylamino-6-methyl-7-anilinofluoran.

* * * * *